United States Patent [19]

Dannert et al.

[11] 4,121,933

[45] Oct. 24, 1978

[54] X-RAY ELECTROPHOTOGRAPHIC RECORDING MATERIAL AND METHOD OF MANUFACTURING SAME

[75] Inventors: Horst Dannert, Aachen-Walheim; Hans-Jürgen Hirsch, Selfkant-Tüddern; Ewald Klein; Karl-Heinz Panstruga, both of Aachen, all of Fed. Rep. of Germany

[73] Assignee: U.S. Philips Corporation, New York, N.Y.

[21] Appl. No.: 827,366

[22] Filed: Aug. 24, 1977

[30] Foreign Application Priority Data

Sep. 11, 1976 [DE] Fed. Rep. of Germany ..... 2641018

[51] Int. Cl.[2] ..... G03G 5/08

[52] U.S. Cl. ..... 96/1.5 R; 96/1 PC; 423/619; 427/419 D

[58] Field of Search ..... 96/1.5; 427/419 D, 419 A, 427/430 R; 423/619

[56] References Cited

U.S. PATENT DOCUMENTS 3,497,382 2/1970 Kwestroo et al. ..... 423/619

*Primary Examiner*—John D. Welsh

*Attorney, Agent, or Firm*—Frank R. Trifari; Carl P. Steinhauser

[57] ABSTRACT

The sensitivity of photoconductive layers of tetragonal lead monoxide in a binder is increased when the tetragonal lead monoxide produced by prior art process after being subjected to a further treatment has a grain size of 1 to 50 $\mu$m and is dispersed in the binder without mechanical force and is sedimented on a layer carrier without mechanical force.

5 Claims, No Drawings

X-RAY ELECTROPHOTOGRAPHIC RECORDING MATERIAL AND METHOD OF MANUFACTURING SAME

The invention relates to an electrophotographic recording material, in particular for X-rays, in which at least a photoconductive layer of tetragonal lead monoxide and a binder is provided on a carrier, and a method of manufacturing the said recording material.

Recording materials having a photoconductive layer are used in electrostatic electrophotography as an X-ray-sensitive layer. The X-ray-sensitive layer is the essential element of an electrophotographic and electroradiographic system, respectively. Electrophotographic and electroradiographic systems, respectively, are to be understood to be a recording method together with a recording device suitable therefor and the materials indicated herefor.

In the absence of radiation the photoconductive layer has a comparatively high electrical resistivity (approximately $10^{14}$ Ohm-cm) which decreases upon exposure to ionizing radiation. The strongly insulating layer is charged electrostatically to a potential $V_o$ in the dark by means of a corona discharge. Upon local exposure to ionizing radiation in accordance with the pattern to be reproduced, the surface charge is reduced in the exposed places by photoconduction. At the end of the exposure the value of the output potential $V_o$ in the exposed places has decreased to a smaller amount V. The latent charge image is then converted into a visible image by means of powdered or liquid developers (toners).

German Auslegeschrift No. 19,56,668 discloses a photoconductive layer for electroradiographic purposes which consists of tetragonal lead monoxide and a binder. The tetragonal lead monoxide used in the manufacture of said layer is manufactured by heating commercially available orthohombic lead monoxide in water and is thus converted into tetragonal lead monoxide to at least 80%. At the end of the conversion the solids are removed, washed, dried and then heated in an inert atmosphere at 350° to 500° C for at least 30 minutes so as to remove remaining impurities. The resulting tetragonal lead monoxide is mixed with the binder, for example, by grinding in an agate ball mill for 24 hours. The resulting photoconductive mass is provided on a layer carrier. The resulting electroradiographic recording material requires 240 mr of the radiation quality indicated in German Auslegeschrift No. 16,56,669 to reduce a surface potential $V_o$ from 100% to 25%.

For evaluating the conductivity of the electroradiographic system, a comparison may be made with the conventional X-ray photography with the film-foil combination. If an electradiographic system is to be taken into account, in addition to the sensitivity of the photoconductive layer, the sensitivity with which the development of the latent electrostatic charge image to the visible pigment image (toner image) occurs. According to the prior art for the development (pigmenting) of latent electrostatic charge images, the result of said comparison is that an electrophotographic X-ray-sensitive layer, when exposed to approximately 10 mr, produces a blackening on developing the electrostatic charge image which exceeds the blackening of film-foil combinations.

It is an object of the invention to increase the sensitivity of photoconductive layers accordingly.

According to the invention, this object is achieved in that a recording material of the kind mentioned in the preamble is characterized in that the tetragonal lead monoxide has a grain size of from 1 to 50μm and in particular from 5 to 20μm.

The recording material according to the invention is preferably manufactured by dispersing tetragonal lead monoxide with the above-indicated grain size without mechanical force in the binder and sedimenting it on the layer carrier without mechanical force.

A particularly advantageous embodiment of the method according to the invention is characterized in that (A) orthorhombic lead monoxide is manufactured from ultrapure lead acetate and ultrapure ammonia solution in very pure deionized water in a vessel of silicate-free material, (B) the orthorhombic lead monoxide in a solution of 1.5 to 18% by weight of ammonia in water is kept at a temperature between 0° and 80° C from 2 to 2000 hours, in which the reaction mixture may be kept in motion, (C) the powdered tetragonal lead monoxide thus obtained is washed with an aqueous ammonia solution of 3½% by weight, dried at 100° to 120° C and, if desired, (a) is heated at a temperature between 110° and 350° C at normal pressure in air for 15 to 120 hours, and (b) if desired, after (a), is heated in an argon flow at 420° to 440° C, kept at this temperature for 1 to 5 hours and cooled to room temperature in a period of time of from 5 to 10 hours, (D) the powdered tetragonal lead monoxide thus aftertreated in a solution of the binder of 2 to 25% by weight, preferably 3 to 10% by weight, which binder is selected from the group of lacquer synthetic resins and polyvinyl carbazole, in an organic solvent is provided on the layer carrier for sedimentation without force, the supernatent binder solution is decanted and the solvent is evaporated, and (E) the recording material thus obtained is heated in air at 150° to 250° C for 1 to 2000 hours, preferably 10 to 25 hours, and is then left to stand, if desired, for at least 20 to 30 hours under the influence of normal spatial illumination.

The manufacture of very pure tetragonal lead monoxide from lead acetate and aqueous ammonia solution in a polyethylene container with subsequent thermal treatment of the resulting precipitate in aqueous ammonia is known per se from J. Inorg. Nucl. Chem. 27 (1965) pp. 1951–1954 and from German Patent Specification No. 15,92,467. However, the use of this method is only one condition for the manufacture of layers having a high quantum efficiency, that is a great sensitivity. Further conditions are: the aftertreatment according to the invention of the lead monoxide powder, as a result of which a high crystallographic perfection is obtained, and the processing according to the invention of the lead monoxide powder together with the organic binders selected according to the invention so that photoconductive layers having a high sensitivity are obtained.

During the investigations which have led to the invention the conversion of the yellow orthorhombic modification of the lead monoxide into the red tetragonal modification was tested particularly elaborately. In this phase of the method the habitude of the converted crystallisate can be strongly influenced and thus the chemical purity and the crystallographic perfection.

The conversion occurs via the liquid phase as a result of the different solubilities of the yellow and red modifications. Upon optimizing said phase of the method, the following parameters have been varied:

(a) the conversion temperature (between 80° and 0° C)

(b) the concentration of the ammonia solution in which the conversion takes place (between 1.5 and 18% by weight)

(c) the dynamic during the conversion, that is conversion in the stationary precipitate and in the precipitate which is kept in motion.

The moist tetragonal monoxide powder manufactured according to the invention is to be subjected to an aftertreatment. Usually, it is washed with aqueous ammonia solution of 3½% by weight and dried at 100° C. According to the invention, the above-indicated further aftertreatments of the powder are carried out in order to increase the sensitivity of the photoconductive layer. It has been found that the nature of the aftertreatment chosen and the binder chosen are related to each other in many cases with respect to the resulting sensitivity.

According to the invention, a sedimentation method is chosen for the manufacture of the actual photoconductive layer. This method is used because it has been found in preceding tests that sensitive layers are obtained only when during the manufacture of the layer as little mechanical force as possible acts on the powder.

For the sedimentation method may be used binders from the group of lacquer synthetic resins such as polyvinyl carbazole dissolved in organic solvents in concentrations of 2 to 25% by weight. The lacquer synthetic resins are indicated in Saechtlich-Zebrowski "Kunststoff-Taschenbuch" 19th edition (Munich-Vienna 1974), pp. 445–448. Polyvinyl carbazole and the following lacquer synthetic resins are preferably used: polymerisates, for example polyacryl- and polymethacyl esters and polystyrene; polycondensates, such as polyester resins, especially alkyd resins, unsaturated polyesters and saturated polyesters, and polyamides.

As solvents for the binders are to be considered, for example: aliphatic ketones, for example butanone, aromatic hydrocarbons, for example toluene, halogenated hydrocarbons, for example chlorobenzene or chloroform, higher esters for example phthalic acid diethylester; and higher alcohols, for example benzyl alcohol.

The layer carrier consists, for example, of aluminum, noble steel, brass, steel or gold vapour-deposited glass.

In the investigations which have led to the invention it was established in particular that when alkyd resins are used as a binder, the choice of the parameters for the conversion of the yellow orthorhombic modification into the red tetragonal modification in many cases has some influence on the sensitivity of the finished PbO layer. It has been found that when the concentration of the ammonia solution is increased from pH 8 to pH 12, an increase of the sensitivity of the finished PbO layer up to a factor 2 is obtained. The other said conversion parameters on the contrary, such as the conversion temperature, precipitate stationary and precipitate in motion, respectively, have no influence on the sensitivity. The investigations have furthermore demonstrated that, when alkyd resins are used as a binder, thermal aftertreatments of the red PbO powder, as already described, so heating at normal pressure in air between 110° and 350° C and also in the argon flow at 420° to 440° C respectively, exert no influence on the sensitivity.

Instead of these thermal treatments, aftertreatment in a high vacuum may be carried out. Heating of the powder in an atmosphere consisting of 10 Torr of oxygen at temperatures between 430° to 460° C for 24 hours has not demonstrated any influence on the sensitivity. A further increase of the partial oxygen pressure to 100 Torr at the said temperatures on the contrary reduces the sensitivity.

It has furthermore been found that when alkyd resins are used an increase of the resin concentration up to 25% in the solution used from which the sedimentation occurs, remains without influence on the sensitivity. The recording material obtained by sedimentation on a layer carrier was dried in air after decanting the supernatent binder solution.

The material is then heated in air at 100° to 250° C, preferably 200° C, for 10 to 50 hours, preferably for 24 hours. As a result of this, the sensitivity became larger to wit approximately a factor 3.

The recording material is then left to stand in artificial illumination for a period longer than 10 hours, preferably for 24 hours. Compared with a storage in absolute darkness, an increase of the sensitivity by a factor 2 is thus obtained.

When saturated polyesters are used as a binder, the investigations have yielded the following results:

The choice of the parameters in the conversion from the yellow orthorhombic into the red tetragonal modification of the lead monoxide was without noticeable influence on the sensitivity of the finished recording material.

For the thermal treatment of the powder in air an upper temperature limit of 350° C is obtained. At higher temperatures higher oxides are formed which cause a reduction of sensitivity. An increase of the sensitivity, however, was usually found when the lead monoxide was heated in an inert atmosphere, preferably in the argon flow, at temperatures of approximately 430° C. The said heating and cooling times of 5 to 10 hours have been increased to 50 hours. As a result of this, however, no further improvements of the results were obtained.

Other investigations with saturated polyesters demonstrate that the sensitivity increases when the resin concentration decreases. The sedimentation preferably occurs from a resin solution of 3%. This value is to be considered as a compromise between sensitivity and mechanical stability of the layer but a certain amount of binder is indispensable for the performance of the layer.

For the measurement of the sensitivity the following method was used: the layer is positioned on a rotating dish. A corona ion source and an X-ray tube are situated in a fixed place above the plate. The layers are charged to a given surface potential by means of the corona. The decrease of the surface potential with X-ray radiation is measured with an influence probe. The decay time to $1/e$ of the initial potential, where $e = 2.718$, is termed the time constant of the discharge and the associated dose (that is the dose which is necessary to reduce the surface potential to $1/e$) is denoted as the sensitivity of the layer. For all the investigations a material test tube (C. H. F. Muller, type MOD 151 Be) was used. The radiation of the tube is subjected to a filtering through 3 mm beryllium (for structural reasons) and extra 440 μm bismuth. The tube is operated at 140 kV and a radiation power of 60 mr/s.

The important advantages of the invention are that as a result of the optimization of the many parameters of the layer manufacture, a sensitivity of approximately 4 mr is achieved and that, while considering the prior art of the pigmentation of the latent electrostatic charge images, the X-ray-sensitive layers according to the invention are equal to or better than the film foil combination as regards their sensitivity in accordance with the application.

The invention will now be described in greater detail with reference to the following specific examples:

EXAMPLE 1

24 g of lead acetate (ultrapure, Merck) are dissolved in 50 ml of deionized water having a resistivity exceeding 10 MOhm cm. 240 ml of 10 *n* ammonia solution are added in 10 to 15 seconds while stirring rapidly. The initially white suspension is then stirred at the same speed for approximately 7 minutes. In this period the conversion of the white basic lead acetate into the yellowish green orthorhombic lead oxide takes place. The precipitate is then washed decantingly 5 times each time with 100 ml of 2*n* ammonia solution. These treatments are carried out in polyethylene vessels.

The orthorhombic PbO powder thus obtained is converted into the tetragonal modification in the dark in 0.5 *n* ammonia solution at 25° C for a period of 5 days. X-ray examinations have proved that the conversion is complete. The obtained particle size was between 5 and 20 μm. The orthorhombic modification could no longer be established. The resulting red PbO powder was heated at 250° C in air at normal pressure for a period of 24 hours.

From a dispersion in 30 ml solution of 3% of a saturated polyester T203 (Witten Chemical Works) (chemical composition: aromatic carboxylic acids and aliphatic dials; physical characteristic numbers: melting range 105° to 150° C, viscosity 0.6 to 0.7) in butanone, 2.2 g of PbO are sedimented on a surface of 27.5 $cm^2$ of aluminum as a layer carrier; the supernatent solvent is decanted. The layer is dried in air and then heated in the dark at 200° C for 24 hours. The sensitivity measurement was carried out repeatedly without exposing the plate to daylight. After this method a sensitivity of 13 mr is obtained.

EXAMPLE 2

The method is the same as in Example 1 but after drying at 250° C (24 hours) a heating in the argon flow is carried out at 430° C for 1 hour. The powder is slowly cooled to room temperature in a period of 5 hours. The same further steps are then carried out. As a result of the extra operation stop, an increase of the sensitivity to 4.5 mr was obtained.

EXAMPLE 3

The orthorhombic modification of the PbO powder is manufactured according to Example 1. The conversion into the tetragonal modification occurs in an approximately 0.2 *n* ammonia solution at a temperature of 15° C for a period of 25 days. The precipitate is washed 5 times by decantation each time with 100 ml of an aqueous 3.5% by weight ammonia solution and dried at approximately 100° C. From a dispersion in 30 ml of 10% solution of alkyd resin (chemical composition: alkyd resin modified with linseed oil which contains pentaery-thrite; physical and chemical characteristic data: 20% by weight of phthalic acid anhydride, approximately 68% by weight of fatty acids, acid number (mg KOH per gram) 6 to 11) in toluene, 2.2 g of PbO are sedimented on 27.5 $cm^2$ of aluminum as a layer carrier, the supernatent solvent being decanted and the layer being dried in air. After a temperature treatment at 200° C for 24 hours, the layer is left to stand in the usual space illumination for at least 24 hours. A sensitivity of 7 mr was established.

EXAMPLE 4

The operation steps of this Example are the same as in Example 3 with the exception that the conversion into the tetragonal modification occurs in an approximately 10 *n* ammonia solution. The resulting sensitivity is 4 mr.

What is claimed is:

1. A method of manufacturing a recording material comprising the steps of (A) forming orthorhombic lead monoxide from pure lead acetate and pure ammonia solution in pure deionized water in a vessel of silicate-free material, (B) storing the orthorhombic lead monoxide in a solution of 1.5 to 18% by weight of ammonia in water for 2 to 2000 hours at a temperature between 0° and 80° C while keeping the reaction mixture in motion, (C) washing the so-formed powdered tetragonal lead monoxide with a 2*n* ammonia solution and drying the powdered tetragonal lead monoxide at 100° to 120° C, (a) heating the lead monoxide thus obtained at normal pressure in air at a temperature between 100° and 350° C for 15 to 120 hours, and (b) after (a), heating it at 420° to 440° C in an argon flow, keeping it at this temperature for 1 to 5 hours and cooling it to room temperature in a period of 5 to 10 hours, (D) sedimenting the powdered tetragonal lead monoxide so obtained in a 2 to 25% by weight solution of the binder which is selected from the group consisting of lacquer synthetic resins and polyvinyl carbazole, in an organic solvent, on a layer carrier without stirring or grinding, the supernatent binder solution and the solvent being evaporated to form a recording material, and (E) heating the recording material thus obtained for 1 to 2000 hours, in air at 150° to 250° C, after which it is stored for at least 20 to 30 hours under the influence of ambient illumination.

2. A method as claimed in claim 1, wherein the after-treated powdered tetragonal lead monoxide is sedimented on the layer carrier from a 3 to 10% by weight solution of a polyacryl or polymethacryl ester, of an alkyd resin, of an unsaturated or saturated polyester, of a polyamide or of polystyrene or polyvinyl carbazole in an aliphatic ketone, an aromatic or halogenated hydrocarbon, a higher ester or a higher alcohol.

3. A method as claimed in claim 2, in which the tetragonal lead monoxide is dispersed in the binding material without the use of mechanical means and is sedimented on the substrate also without mechanical means.

4. Recording material manufactured in accordance with the method as claimed in claim 1, in which at least one photoconductive coating of tetragonal lead monoxide with a grain size range of 1 – 50 μm and a binding material is disposed on a substrate.

5. Recording material as claimed in claim 4 in which the tetragonal lead monoxide has a grain size of 5 to 20 μm.

* * * * *